United States Patent [19]

Aspinwall

[11] Patent Number: 4,708,209

[45] Date of Patent: Nov. 24, 1987

[54] MANUALLY OPERATED IMPACT DRIVER

[76] Inventor: Hugh M. Aspinwall, 2580 26th Ave., San Francisco, Calif. 94116

[21] Appl. No.: 764,579

[22] Filed: Aug. 12, 1985

[51] Int. Cl.[4] ..... B25D 15/00

[52] U.S. Cl. ..... 173/93; 173/94; 81/463

[58] Field of Search ..... 173/93, 94, 93.5, 96, 173/104, 109, 119, 97; 81/463, 465, 466, 52; 29/243.53, 254, 275

[56] References Cited

U.S. PATENT DOCUMENTS

| | | | |
|---|---|---|---|
| 947,391 | 1/1910 | Michael | 81/463 |
| 2,010,616 | 8/1935 | Walsh | 173/93.7 |
| 2,140,465 | 12/1938 | Bangs | 29/10 |
| 2,450,185 | 9/1948 | Craven | 173/93 |
| 3,010,193 | 11/1961 | Croall et al. | 408/124 |
| 3,156,309 | 11/1964 | Swenson | 173/93 |
| 3,177,910 | 4/1965 | Da Silva | 81/177.3 |
| 3,210,832 | 10/1965 | Kalen | 29/747 |
| 3,407,499 | 10/1968 | Rapaport | 30/367 |
| 3,783,956 | 1/1974 | Schultz | 173/93.7 |
| 3,789,896 | 2/1974 | Cooke-Yarborough | 173/93 |
| 3,900,058 | 8/1975 | McArdle | 81/463 |

*Primary Examiner*—E. R. Kazenske
*Assistant Examiner*—James L. Wolfe
*Attorney, Agent, or Firm*—Robbins & Laramie

[57] ABSTRACT

Hand held tool for applying a rotational impact to a fastener. Means including a windable spring are mounted on the tool body for storing energy, which can be release and transmitted mechanically to other means engaging the fastener, to apply a rotational impact force to the fastener. The tool is useful for small fasteners and delicate workpieces, where the rotational impact should be applied with little or no axially-directed thrust force component.

4 Claims, 5 Drawing Figures

MANUALLY OPERATED IMPACT DRIVER

BACKGROUND OF THE INVENTION

This invention relates to manually operated devices for assisting in loosening and tightening fasteners. The fasteners utilized in conjunction with the device are screws, nuts, bolts, and the like.

Until the present invention, the loosening or tightening of fasteners required the application of force to the fastener either by hand, with a screwdriver or wrench, or by means of a power device. Standard power devices most commonly make use of electrical, pneumatic or hydraulic power sources.

One of the drawbacks of such tools as actually used with fasteners exhibits itself when the fastener is either difficult to loosen or difficult to tighten. In these cases, the individual using the hand tool either tends to or is required to apply extreme force to the fastener by way of the tool. Many times this force results in damage to the fastener, as with scarred screwheads or rounded corners on a bolthead, damage to the workpiece if the tool slips from the fastener, or damage to the tool itself.

The power tools present a different problem in that they are generally made for use with larger fasteners and are so manufactured that a large amount of energy is applied to the fastener. These power tools are, therefore, generally inappropriate for use with small fasteners or fasteners contained in small or delicate workpieces.

With both hand-held and power driven tools, it is a common practice to apply to the fasteners not just the torque that is required to loosen or tighten the fastener, but in addition, to apply an axially-directed thrust force. For many applications such a thrust force is undesirable and should be avoided completely.

BRIEF SUMMARY OF THE INVENTION

In one embodiment, the present invention is a hand-held tool that is useful for applying a rotational impact to a workpiece. The workpiece may be a fastener and the tool is intended for use with fasteners and workpieces that must be treated delicately, with a minimum of force.

The tool has a body and some means mounted on the body for storing energy. The tool is also provided with some means, mounted on the tool body, for engaging a workpiece. This means may be, for example, a screwdriver bit. The tool also is provided with means for causing the release of the stored energy, and with means actuatable upon release of the stored energy to be driven to transmit a rotational impact to the means engaging the workpiece.

The function performed by this tool is the conversion of the stored energy to a rotational impact that is applied to the fastener or other workpiece. This rotational impact may be applied with substantially no axial thrust component.

A preferred, simple embodiment of the invention is a hand held tool for applying a rotational impact to a workpiece that comprises a tool body, means mounted on said body for storing energy comprising a spring that may be wound up by rotating it, and a mass that may be caused to rotate about said body upon unwinding of said spring, means mounted on said body for engaging a workpiece, and means mounted on said body for causing release of said spring when wound, to release said stored energy, said mass being actuatable upon release of said stored energy to be driven through a rotary movement about said body, to transmit a rotational impact to said means for engaging the workpiece, whereby said stored energy is converted to rotational impact that is applied to said workpiece.

This tool is designed to provide rotation of the energy-storage mass about the axis of the tool body, when driven by the wound spring. This rotation is relative to the tool body and is independent of the workpiece-engaging means, which preferably is a screwdriver bit. Once the spring is released to cause the mass to rotate, some finite time is required to permit acceleration of the mass, so that it gains angular velocity against the opposing forces of friction and inertia. At the limit of its angular travel, the tool is designed so that the mass delivers its energy to the screwdriver bit or other work-engaging means. The angular momentum of the mass is thus transferred to the screwdriver bit, which then applies a rotational impact to a fastener.

It is within the scope of the invention to adjust the parts of the tool so that the energy-storage mass travels through essentially a complete revolution or less than a complete revolution. The angular extent of travel of the mass may be adjusted in order to adjust its impact and thus the rotational impact that is applied by the tool. Thus for an extremely delicate workpiece, the angular extent of travel may be adjusted to be very small. For a more rugged workpiece, more than one rotation may be desirable, to permit a buildup of angular momentum and hence a greater impact.

In all of the variations of the tool, the rotational impact may be applied without an axially directed force component, except to the extent such a force is applied manually by the user of the tool.

DETAILED DESCRIPTION OF THE INVENTION

Figure 1:
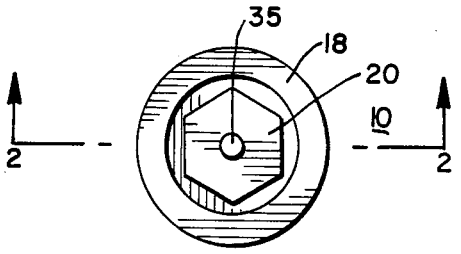
FIG. 1 is a top plan view of a hand-held tool constructed in accordance with one preferred embodiment of the invention.

Referring now in detail to the drawings by numerals of reference, the numeral 10 denotes generally a limited rotational impact screwdriver constructed in accordance with one preferred embodiment of the invention. This screwdriver is formed with an elongate, generally cylindrical body 12. At its upper end, this body is formed with a generally cup-shaped recess 14. At its upper end, this recess is provided with internal threads 16.

A collar 18 is seated about the upper end of the body 12, and circling the body about the open end of the recess 14. A nipple 20 having a threaded projecting part 24 is threaded into the threaded bore 16 of the recess 14. This nipple is formed with an enlarged diameter shoulder part 26 that engages against the upper face of the collar 18.

Toward the lower end of the recess 14, a vertically extending slot 28 is formed in the wall 30 that surrounds the recess 14. A generally ring-shaped disc member 32, that is formed with a central opening, is mounted about the wall 30 of the body, for sliding movement along the length of the body. The disc 32 is formed with a pin 34 that is engaged in the slot 28, to limit the extent of travel of the disc 32, and to hold the disc 32 against rotary movement relative to the body 12.

The disc 32 is formed with a vertically extending slot 37 (FIG. 3) that is open at the periphery of the disc 32.

A generally tubular sleeve 38 is mounted about the body 12, interposed between an enlarged diameter shoulder portion 40 of the body, and the collar 18. At its upper end, the sleeve 38 is proportioned for a sliding fit about the outer, cylindrical surface of the disc 32. At its lower end, the sleeve is formed with a closure ring 42 that has a central opening to permit the ring 42 to ride on and undergo rotary movement relative to the confronting surface of the body 12.

A spring 44 is mounted about the body 12 within the bore of the sleeve 38, and has an axially projecting lower end 46 that is staked in a recess in the ring 42. The spring 44 is also formed with an axially-projecting upper end 48 that is secured in a bore in the disc 32.

Figure 2:
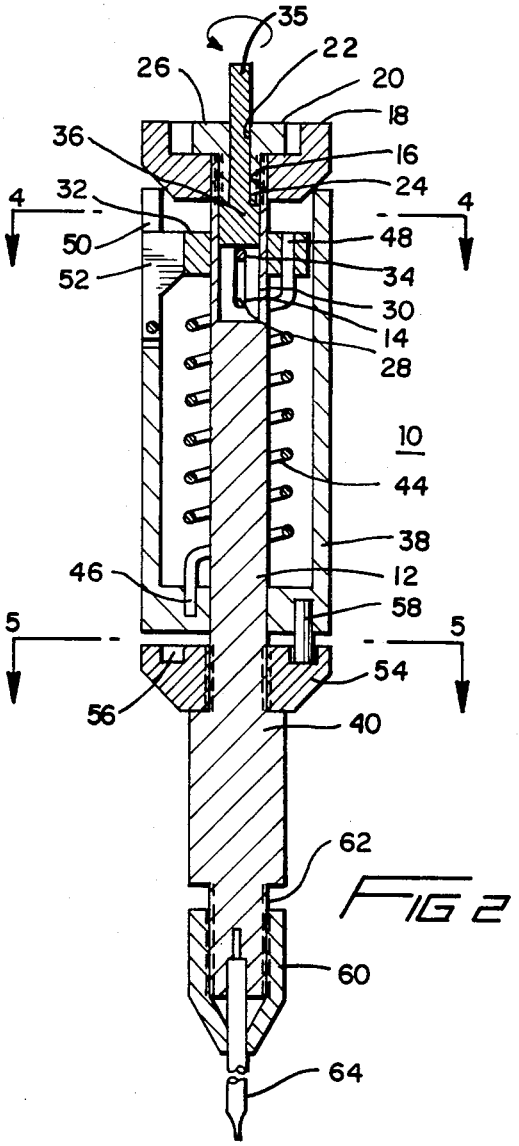
FIG. 2 is a fragmentary part side elevation, part section taken on the line 2—2 of FIG. 1 looking in the direction of the arrows, and showing the energy storing spring locked in its energy-stored position.
Figure 3:
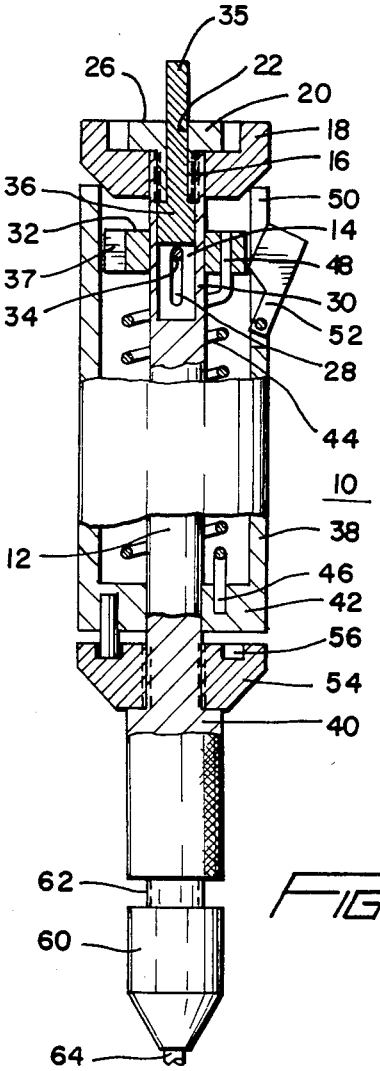
FIG. 3 is a fragmentary section taken on the line 2—2 of FIG. 1, looking in the direction of the arrows, showing the energy-storing spring in its energy-released position, and with the locking means in its unlocked position.
Figure 4:
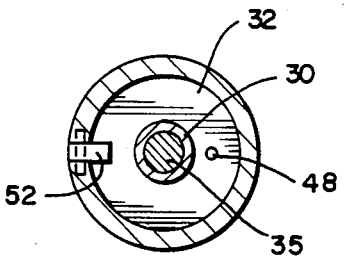
FIG. 4 is a transverse section taken on the line 4—4 of FIG. 2, looking in the direction of the arrows.

Adjacent its upper end, the sleeve 38 is formed with an axially-extending slot 50. A latch member 52 is pivotally secured at its lower end to the sleeve for pivotal movement in and out of the slot 50. In its inner position as shown in FIG. 2, the latch member 52 engages in the slot 37 in the disc 32. In its pivoted-out position, the latch member 52 projects above the outer surface of the sleeve 38 and rides against the outer surface of the disc 32, as shown in FIG. 3. Although not shown for simplicity of illustration, the latch member 52 is spring-biased so that it is constantly urged to its pivotally inward position, that is, the position shown in FIG. 2.

Figure 5:
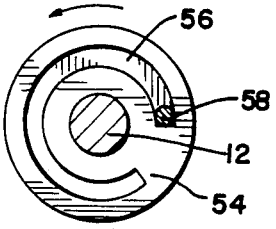
FIG. 5 is a transverse section taken on the line 5—5 of FIG. 2, looking in the direction of the arrows. The arrow adjacent FIG. 5 indicates the direction of rotation of the sleeve and of the pin that depends from the sleeve, upon release of the latch or lock that permits the spring to release its stored energy.

A lower collar member 54 is mounted about the body 12 and is rigidly secured thereto, so that there can be no relative movement between the lower collar 54 and the body 12. The lower collar 54 engages against the shoulder portion 40 of the body 12. In its upper face, the collar 54 is formed with an arcuate slot 56 (FIGS. 2, 3 and 5). A pin 58 is disposed to project from the lower end of the sleeve 38 and to engage in this slot 56. The angular extent of the arcuate slot 56 may be adjusted by the use of more than one lower collar member 54 (not shown). Angular adjustment of two lower collar members would result in regulatable variations in the effective angular extent of arcuate slot 56.

Adjacent its lower end, the body has a collet 60 threaded onto a reduced diameter part 62 of the lower end of the body. The body is also formed with a recess in which a screwdriver bit 64 or other tool can be seated, to be secured in place by tightening the collet 60.

A plunger rod 35 is disposed at the upper end of the body, with its upper end disposed for sliding, reciprocating movement within the bore 22 of the nipple 20. The plunger rod 35 has an enlarged diameter lower end 36 that projects below the lower end of the nipple 20, and that is disposed for sliding movement within the cup-shaped recess in the upper end of the body 12. The lower face of the enlarged diameter portion 36 of the plunger rod 35 is engaged against the pin 34, for a purpose to be described presently.

To use the tool, the spring should be wound up to store energy. After the spring has been wound, the tool is ready for use. To wind the spring, the sleeve 38 is held stationary and the body 12 is turned in a direction that winds up the spring, from the position shown in FIG. 3, with the latch open, to the position shown in FIG. 2, with the latch 52 engaged in the slot 37 in the disc 32. The tool is then ready for use. The screwdriver bit 64 is inserted in the head of a screw, for example, as gently as is required by the item being worked upon.

The body of the tool is then grasped just below the shoulder 40, to hold the body stationary. "Stationary" in this context refers to a position of the tool relative to a fastener, and in no way implies a grasping or clamping of the tool such that it is immovably held and transfer of rotational impact from the tool body to the fastener is prevented. The plunger 35 is then depressed. As the plunger 35 is pressed down, it engages against the pin 34 and presses it down. The pin 34 carries with it the disc 32, and at the extreme lower limit of travel of the pin 34 and disc 32, the latch 52 is disengaged from the slot 37. The sleeve 38 then being free to rotate, does rotate relative to the tool body 12, under the pressure exerted by the spring 44. The sleeve 38 rotates until the pin 58 has moved through the slot 56 a sufficient distance to engage against the end of the slot, see FIG. 5. When the pin 58 strikes against the end of the slot, the inertia or momentum of the sleeve is transmitted through the pin 58 to the collar 54 and thus to the body 12 of the tool and to the screwdriver bit 64. The inertia or momentum of the sleeve is thus transferred through the screwdriver bit 64 to the fastener.

When properly used, the tool can apply a rotational impact of a preselected value that can be adjusted by selecting the proper spring and mass for the sleeve 38, or by adjusting the number of rotations through which the spring will be wound. Again, properly used, the rotational impact can be applied free of any axially-directed thrust component. The tool of the present invention thus offers several advantages. It provides a means for loosening or tightening very small fasteners, especially those contained in delicate workpieces, without the need for the application of extreme force to the fasteners. It also provides a means for applying mechanical impact for the loosening or tightening of small fasteners, without the need for supplying external power to the tool, and without the application of an axially-directed thrust force component. The application of essentially pure rotational impact force to a fastener guards both the fastener and the workpiece from potentially dangerous pressure and stresses that might be produced by an axially-directed thrust force component.

While the tool has been described with respect to the use of a screwdriver bit, it could as well be used with any of a number of types of wrenches or adaptors. In addition, many different types of screwdriver bits could be used.

The size, weight, and rotational impact applied by the tool may be adjusted to a very low torque force, so as to be applicable to the smallest fasteners, such as those used in cameras, clocks, and similar small or miniature mechanisms, or it may be adjusted to be increased to be useful with larger fasteners, such as those used in plumbing, automotive, or other large mechanisms.

The single rotation mechanism embodiment winds down and latches itself ready for the next operation. The multiple rotation device must be held unlatched through several rotations.

While the invention has been disclosed in this patent application by reference to the details of preferred embodiments of the invention, it is to be understood that this disclosure is intended in an illustrative rather than in a limiting sense, as it is contemplated that modifications will readily occur to those skilled in the art, within the spirit of the invention and the scope of the appended claims.

What is claimed is:

1. A hand held tool for applying a rotational impact to a workpiece comprising an elongate, generally cylindrical tool body, means mounted on said body for engaging a workpiece, means for storing energy mounted on said body and comprising a generally tubular sleeve that is mounted about a part of said body for rotary movement relative to said body, one of said sleeve and said body formed with an axially projecting member and the other of said sleeve and said body formed with a part having a slot in which said member can travel, the angular extent of said slot defining and limiting the relative angular movement between said sleeve and said body, spring means interposed between said sleeve and said body, said sleeve being rotatable about said body from one extreme position where said spring is in an at rest position to a second extreme position where said spring has energy stored therein, and releasable means for locking said sleeve against movement relative to said body in said second position, said locking means being releasable to permit said spring to release its energy and to apply a force to urge relative rotary movement between said sleeve and said body, whereby when said sleeve is held stationary relative to said workpiece, said body is urged to rotate to apply rotational impact to said workpiece.

2. The hand held tool of claim 1 wherein said means for engaging a workpiece is a screwdriver bit.

3. The hand held tool of claim 1 wherein said means for engaging a workpiece is a wrench head.

4. The hand held tool of claim 1 wherein the rotational impact is applied to the workpiece in a rotary mode substantially free of any axial thrust component.

* * * * *